United States Patent [19]

Brass

[11] 4,422,134

[45] Dec. 20, 1983

[54] LUMINAIRE WITH IMPROVED ILLUMINATION OF A VISUAL TASK FIELD

[75] Inventor: John R. Brass, San Rafael, Calif.

[73] Assignee: Metropolitan Furniture Corp., San Francisco, Calif.

[21] Appl. No.: 276,043

[22] Filed: Jun. 22, 1981

[51] Int. Cl.[3] ..... F21V 7/00

[52] U.S. Cl. ..... 362/300; 362/33; 362/299; 362/301; 362/346; 362/375

[58] Field of Search ..... 362/33, 300, 299, 301, 362/346, 375

[56] References Cited

U.S. PATENT DOCUMENTS

| | | | |
|---|---|---|---|
| 2,896,066 | 7/1959 | Quetin | 362/33 |
| 4,159,511 | 6/1979 | Dejone | 362/804 |
| 4,186,433 | 1/1980 | Baldwin | 362/303 |
| 4,231,080 | 10/1980 | Compton | 362/298 |

*Primary Examiner*—Stephen J. Lechert, Jr.

*Attorney, Agent, or Firm*—Phillips, Moore, Lempio & Finley

[57] ABSTRACT

A luminaire comprises a high intensity light source for emitting a spherical light pattern, a redirection module for converting the spherical light pattern into a radial light pattern, and a reflector module for reflecting the radial light pattern into a controlled and substantially uniform light pattern onto a visual task field.

21 Claims, 4 Drawing Figures

LUMINAIRE WITH IMPROVED ILLUMINATION OF A VISUAL TASK FIELD

DESCRIPTION

1. Technical Field

This invention relates generally to a luminaire for illuminating a visual task field and more particularly to a luminaire for converting the spherical light pattern of the light source to a radial light pattern and for reflecting the radial light pattern to provide a precisely controlled and substantially uniform light pattern on the visual task field.

2. Background Art

Luminaires are utilized to control a source of light so that it can be better used for a given seeing task. Materials and constructions employed in such luminaires are designed to reflect, refract, transmit, diffuse, and/or obscure light. In any particular luminaire application, the primary object is one of providing in an energy efficient manner sufficient illumination for a given seeing task without introducing visual discomfort or disability. Although conventional luminaires and light sources thereof will normally provide adequate light, they usually produce direct glare towards the user's eyes and reflected lamp and/or reflector glare superimposed on the visual task.

For example, conventional high-intensity lamps produced a blurred, but intense image of each lamp superimposed on the visual task. This superimposed brightness reduces the contrast between graphic symbols and the surface on which the symbols appear. This so-called "reflected glare" is normally the greatest when the lamps illuminate areas directly below and within a twenty-five degree (25°) downward cone ("the offending zone") having its apex emanating from the lamps. Furthermore, luminaires employing specular reflectors with the high-intensity lamps generally produce spotty and/or striated light patterns on the visual task field.

The high-intensity lamps employed in conventional luminaires of the above type tend to produce a significant amount of direct glare primarily since the lamps are normally poorly shielded from the viewer's eyes. In addition, perimeter reflectors employed on the luminaires generally develop excessive (glaring) brightness toward the viewer's eyes. These effects are exaggerated when the luminaires are tilted upward in order to spread-out the relatively concentrated light pattern.

DISCLOSURE OF INVENTION

An object of this invention is to provide a luminaire for essentially eliminating direct glare and for minimizing reflected glare and to allow a high percentage of lamp output to be delivered to a visual task field from a multiplicity of secondary sources rather than directly from one or two primary "point" sources.

The luminaire of this invention comprises light source means for emitting a spherical light pattern, first means for converting the spherical light pattern into a radial light pattern, and second means for receiving and reflecting the radial light pattern into a controlled and substantially uniform light pattern onto the visual task field.

BRIEF DESCRIPTION OF THE DRAWINGS

Other objects and advantages of this invention will become apparent from the following description and accompanying drawings wherein.

BEST MODE OF CARRYING OUT THE INVENTION

General Description

Figure 1:
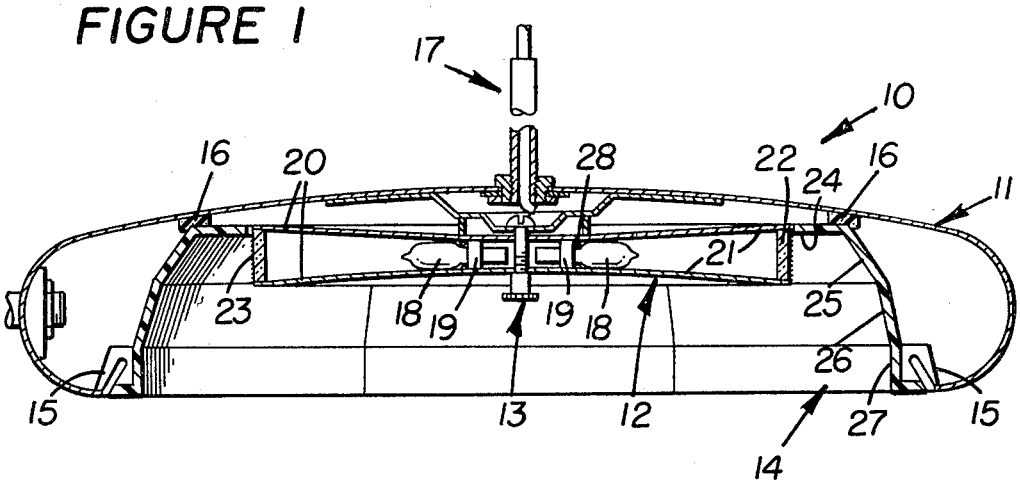
FIG. 1 is a cross-sectional view through a luminaire embodying the present invention.

FIG. 1 illustrates a luminaire 10 comprising an annular housing 11 having a radial light redirection module 12 releasably secured therein by fastening means comprising a standard thumb nut 13. A reflector module 14 is releasably attached in housing 11 by a plurality (e.g., four) of circumferentially spaced, flexible holding barbs 15. The barbs aid in positioning and maintaining the reflector module in the housing along with an annular elastomeric sealing gasket 16 compressed between the reflector module and housing.

It will be understood by those skilled in the arts relating hereto that although luminaire 10 is shown as having a low-profile, annular shape adapted for attachment as a ceiling fixture by a cord and stabilizer shaft 17, that the luminaire may have other shapes and may be wall-mounted, mounted on a pedastel for disposition on a desk, or the like, etc.

Figure 4:
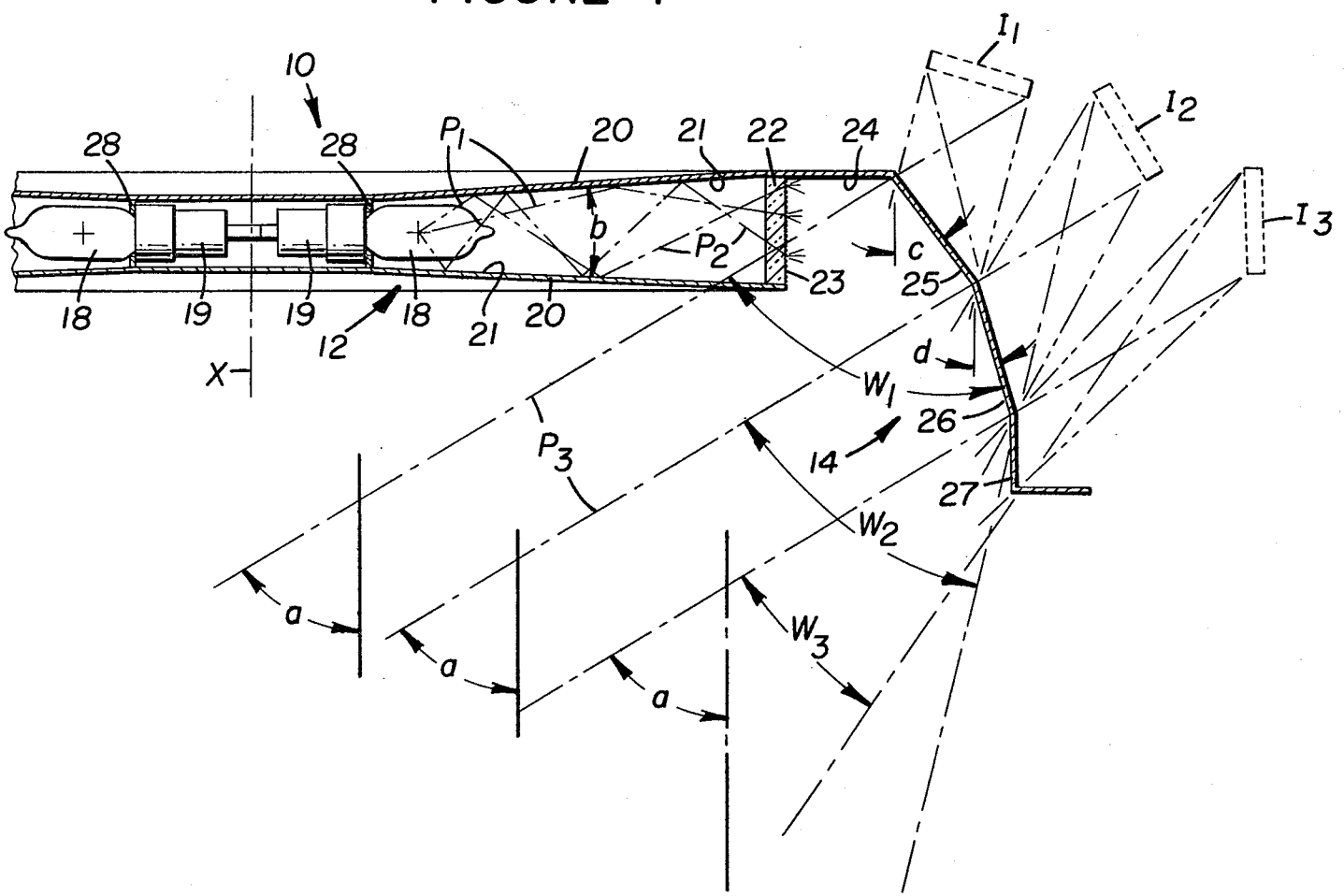
FIG. 4 schematically illustrates typical light patterns emanating from the luminaire.

As described more fully hereinafter and as shown in FIG. 4, luminaire 10 is adapted for mounting above (e.g., 18 in.) a 2×3 foot task field on a desk, for example. The luminaire further comprises a light source means, shown in the form of a plurality (e.g., two) of miniature, high-intensity lamps 18, each mounted in an electrical socket 19 for emitting a spherical light pattern $P_1$ therefrom. Redirection module 12 functions as a first means for converting the spherical light pattern into a radial light pattern $P_2$ which is directed onto reflector module 14. The reflector module comprises second means for receiving and reflecting the radial light pattern into a controlled and substantially uniform light pattern onto the visual task field.

As will be further appreciated by those skilled in the art, the radial light redirection module of this invention is adapted to illuminate other types of task fields, such as clock faces, signs, and the like.

Detailed Description

Figure 2:
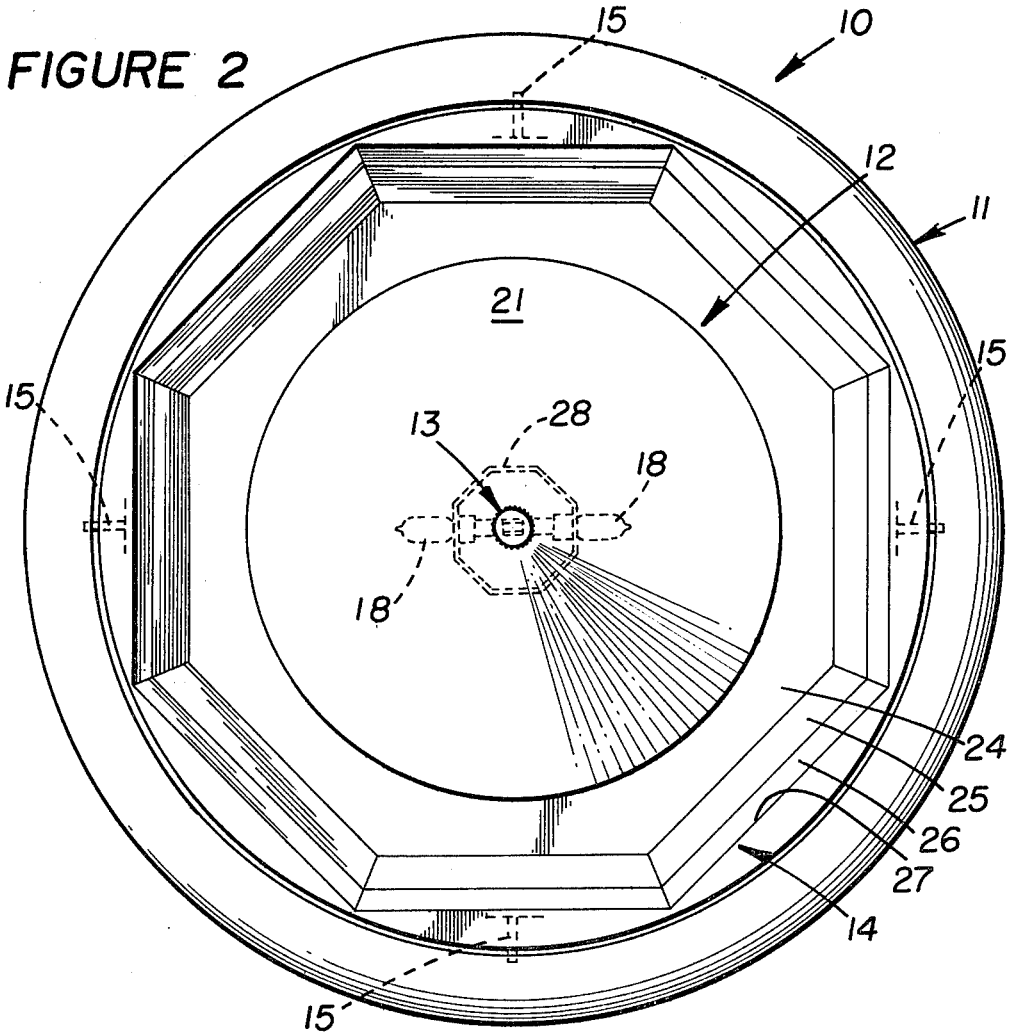
FIG. 2 is a bottom plan view of the luminaire.
Figure 3:
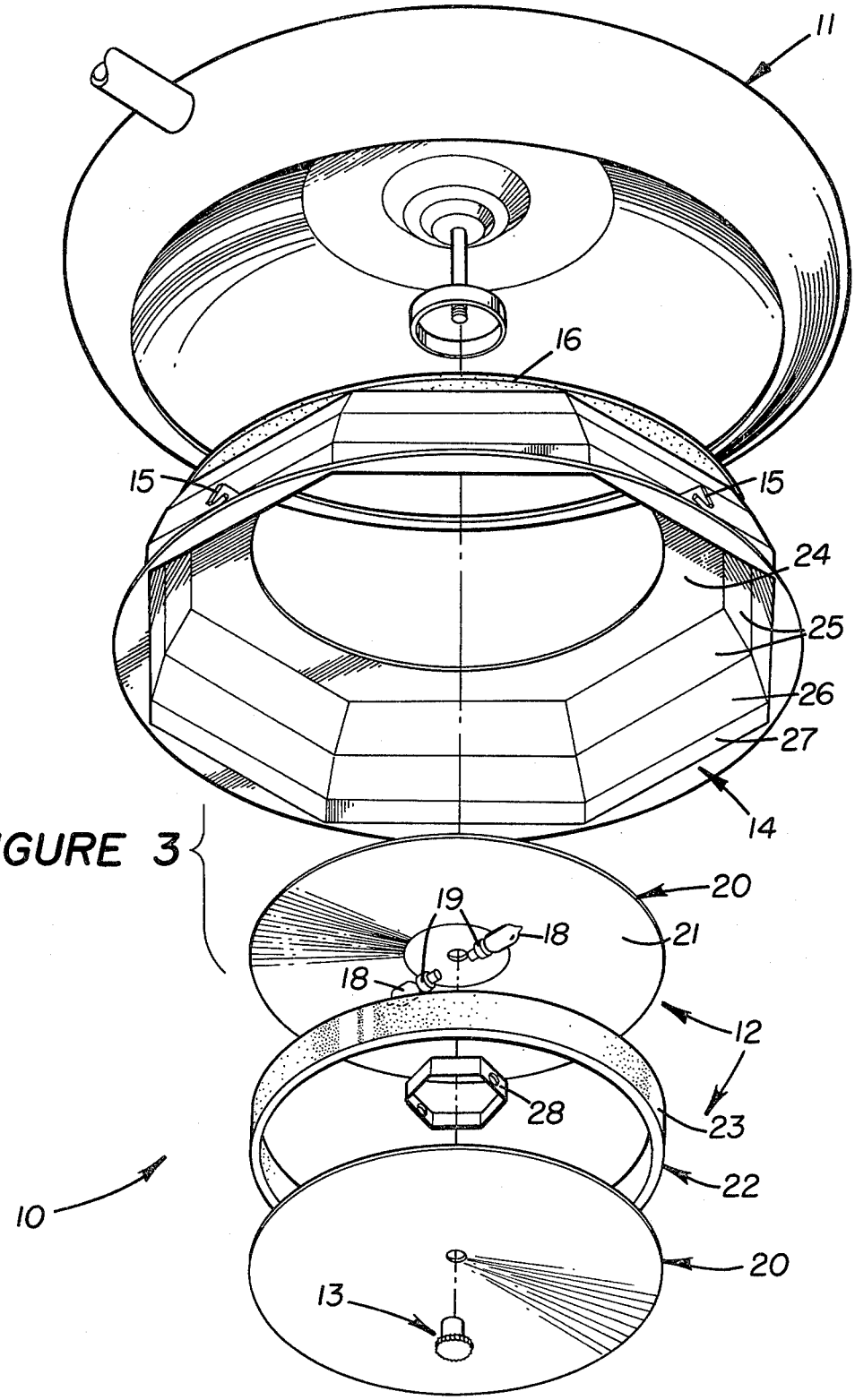
FIG. 3 is an exploded, isometric view of the luminaire.

Referring to FIGS. 1–3, lamps 11 may be of the standard wedge base halogen type, each having a rating of eighteen watts at 250 lumens and 22.5 volts and exhibiting a service life of approximately 3000 hours. Radial light redirection module 12 for converting a spherical light distribution of the lamps to radial light distribution, may comprise a pair of annular reflector disks 20 extending radially outwardly from the lamps in diverging relationship relative to each other. Inner surfaces 21 of the disks have a mirror finish, preferably composed of a super-reflective material to provide a reflectivity efficiency of at least ninety-four percent (94%).

For example, the surfaces may comprise a polished and electro-brightened aluminum sheet suitably coated with a standard transparent coating (e.g., anodic) to provide the desired reflective properties and protection to the polished surfaces. Since the techniques for making mirror finishes of this type by utilizing "super-reflective" materials to provide the maximum degree of reflectivity, further discussion thereof is deemed unnecessary for a full understanding and practice of this invention.

Redirection module 12 further comprises an annular transparent window or lens 22 clamped and sandwiched between the outer ends of disks 20 by the fastening means comprising thumb nut 13 to produce convex mirrors for efficient radial redirection and semi-diffuse transmission of the light towards reflector module 14. The window may be composed of a clear, colorless acrylic plastic (Plexiglas) which will exhibit a long service life and color stability. An outer surface 23 of the window is preferably formed with a fine stippled pattern (e.g., Rohm and Hass DP-30) to provide the desired control of light diffusion therethrough without absorbing any more light than would be experienced with a smooth-surface window.

The radial light pattern is then intercepted and reflected by radial light reflector module 14. The reflector module may comprise a suitable polymer which is injection molded to form the module with holding barbs 15 thereon. For example, the polymer could constitute acrylonitrilebutadienestyrene (ABS), which is processed by blending acrylonitrile-styrene plastic copolymer with a butadiene-acrylonitrile rubber copolymer or by interpolymerizing polybutadiene with styrene and acrylonitrile. The cured polymer combines the advantages of hardness and strength of the vinyl plastic component with the toughness and impact resistance of the rubbery component to ensure a long service life and the ability to treat the inner surfaces thereof for light reflection purposes.

Reflector module 14 comprises a radial plane reflector 24 which forms a radial extension of upper reflector disk 20 and three sharp cut-off perimeter reflectors 25, 26, and 27 that circumvent redirection module 12. Reflectors 24–27 may be formed with a mirror finish, similar to surfaces 21, but not thin-film coated. In the embodiment illustrated in FIGS. 1–3, each circumferential group of perimeter reflectors 25–27 are shaped octagonally, when viewed in plan, to comprise eight contiguous and rectangular reflector elements. It should be understood, however, that other shapes could be utilized, as will be appreciated by those skilled in the arts relating hereto.

Reflectance efficiency of redirection module 12 is increased by securing an octagonally-shaped inter-reflector member 28 between disks 20 and at the radial inner ends of lamps 18. The outer surfaces of the inter-reflector member can also be provided with a mirror finish of the type described above for surfaces 21 and reflectors 24–27.

DISCUSSION OF SECTOR LIGHT REDIRECTION PRINCIPLE

FIG. 4 schematically illustrates the basic principles under which luminaire 10 functions to efficiently illuminate a task field, positioned eighteen inches below the luminaire, for example. Again summarizing such basic principles, lamps 18 provide a light source means for emitting a spherical light pattern $P_1$. The light pattern is intercepted and reflected by inner surfaces 21 of reflector disks 20 to provide first means for converting the spherical light pattern to a radial light pattern $P_2$ which proceeds through window 22 and towards reflector module 14.

As discussed above, the window will provide the desired amount of controlled diffusion through fine stippled surface 23 thereof without absorbing any more light than a smooth and unstippled window. Inter-reflector member 28 will cooperate with reflector disks 20 to reflect the maximum amount of light through the window, which will provide moderate (beam-smoothing) diffusion. Radial plane reflector 24 will aid in efficiently directing the radial light pattern to perimeter reflectors 25–27 of reflector module 14.

Reflector module 14 will then function as second means for receiving and reflecting the radial light pattern into a controlled and substantially uniform light pattern $P_3$, onto the visual task field. FIG. 4 illustrates images $I_1$, $I_2$, and $I_3$ of the window in mirror facets on perimeter reflectors 25, 26, and 27, respectively. A first beam width $W_1$ from perimeter reflector 1 will provide the central and peripheral portion of the illumination pattern on the task field. A second beam width $W_2$ from perimeter reflector 26 will function to strengthen the central and peripheral portion of the illumination pattern, as depicted by the overlapping of beam widths $W_1$ and $W_2$ in FIG. 4. A third beam width $W_3$, from perimeter reflector or mirror facet 27, functions to overlap beam width $W_2$ to strengthen the peripheral portion of the illumination pattern, as shown.

As further shown in FIG. 4, window 22 is preferably oriented in parallel relationship relative to a central axis X of luminaire 10, whereas radial plane reflector 24 is shown as being approximately perpendicular thereto. Angles "a" represent the sharp cut-off of the images (glare) whereby the visual task field is uniformly illuminated. In a functional embodiment of applicant's invention, angle "a" approximated 60° with the luminaire being positioned eighteen inches above the task field. In addition, an included angle "b" between at least substantial portions of diverging reflector disks 20, closely approximated 7°. Beam widths $W_1$, $W_2$, and $W_3$ were calculated as approximating 72°, 46°, and 25°, respectively. First and second groups of perimeter reflectors 25 and 26 formed acute angles "c" and "d" closely approximating 35° and 15°, respectively, relative to central axis X and window 22, whereas third group of perimeter reflectors 27 was formed substantially parallel therewith.

The graduated downward decrease in these angles of the perimeter reflectors aid in providing the above-mentioned controlled and substantially uniform light pattern reflected onto the visual task field. It should be understood that the number of groups of such perimeter reflectors, as well as the orientations thereof relative to axis X and window 22, will vary depending on the particular luminaire design under consideration. It has been found in general use that an eighteen inch mounting height of luminaire 10 above the visual task field is normally preferred, although vertical height adjustment will be found useful for certain visual tasks.

In the above-mentioned functional embodiment of applicant's invention, the radial redirection module was constructed with a diameter of seven and one-half inches, which is suitable for many visual tasks, whether ceiling, wall, or table mounted. Experimentation has shown that the luminaire, at the worst possible viewing angle, exhibited a 2:1 contrast ratio with black printing on glossy paper. In contrast thereto, it was found that a conventional high intensity luminaire produced a negative contrast, i.e., the black printing actually became a little brighter than the white paper.

Harsh shadows were noted as being substantially eliminated with use of luminaire 10, primarily due to the twenty-four (24) secondary light sources provided by perimeter reflectors 25–27. In contrast thereto, the conventional luminaire was noted to produce a very harsh shadow. In addition, the illumination level and reflected glare resulting from the use of luminaire 10 was noted as being much less influenced by the relative position of the visual task field in comparison to the conventional luminaire, which exhibited drastic changes in the light level and the luminaire, e.g., from flat on a desk to hand-held. Since the luminaire produced twenty-four (24) peripheral sources of light, rather than a point source of light, the illumination levels produced were found not to conform to commonly known inverse square law, i.e., illumination of the inner surface of a sphere is equal to an isotropic point source of intensity divided by the radius of the sphere squared ($E=I/R^2$).

It will thus be appreciated by those skilled in the luminaire arts that applicant's luminaire is capable of delivering significantly more light to a visual task field per unit of input power (watts) than conventional luminaires employing fluorescent or other types of standard lamps therein. This is so even though the high intensity lamps used have (in themselves) lower efficiency than large source lamps, such as fluorescent lamps. Furthermore, applicant's luminaire prevents direct illumination of the visual task field (extreme reflected glare). The luminaire provides a high percentage of usable light on the visual task field in comparison to conventional luminaires having exposed lamps.

As shown in FIG. 1, luminaire 10 is adapted to provide a low-profile form that otherwise would not be feasible in respect to conventional luminaires exhibiting intense direct glare from exposed lamps. Luminaire 10 will also provide relatively cool operation in that reflector disks 20 will function to spread-out and dissipate conducted and convected lamp heat in contrast to conventional designs. The highly efficient reflection of lamp light output (and radiant heat) will aid in minimizing luminaire temperature rise. It should be further noted that the above-described material makeup of luminaire 10 will provide it with a long service life without yellowing or other deterioration.

Lamps 18 are readily accessible for expeditious replacement and are fully protected, along with the reflective surfaces 21 of disks 20, against contamination due to the sealed relationship of window 22 between the disks. The vertical disposition and annular shape of the window ensures that dust, greasy fumes, and the like cannot settle thereon to interfere with the desired operation of the luminaire. The compact and protected disposition of lamps 18 within redirection module 12 also protects the lamps against common causes of failure, such as thermoshock, accidental impact, damaging effects of acccumulated dust and grease, and the like. Protection is also provided to the user against intense lamp heat and the unlikely occurrence of lamp breakage.

I claim:

1. A luminaire of the direct lighting type adapted for mounting adjacent to a visual task field comprising light source means for emitting a spherical light pattern, first means for directly converting said spherical light pattern to only a radial light pattern, and second means for directly receiving and reflecting said radial light pattern into a controlled and substantially uniform light pattern onto said visual task field.

2. The luminaire of claim 1 wherein said luminaire is disposed on a central axis thereof and said light source means comprises at least one high-intensity lamp mounted radially inwardly on said first means.

3. The luminaire of claim 1 wherein said luminaire is disposed on central axis thereof and said first means comprises a pair of axially spaced opaque reflector disks confining all of said spherical light pattern therebetween and each having a reflective inner surface extending radially outwardly from said axis towards said second means.

4. The luminaire of claim 3 wherein at least substantial portions of said disks diverge radially outwardly from each other from said axis.

5. The luminaire of claim 3 further including window means secured radially outwardly between outer ends of said disks for semi-diffuse transmission of said radial light pattern toward said second means.

6. The luminaire of claim 5 wherein a radial outer side of said window means has a fine stippled pattern formed thereon to provide said semi-diffuse transmission of said radial light pattern.

7. The luminaire of claim 1 wherein said second means comprises a plurality of interconnected sharp cut-off perimeter reflectors disposed radially outwardly from said first means.

8. The luminaire of claim 7 wherein said perimeter reflectors circumvent said light source means and said first means and are each at least generally flat.

9. The luminaire of claim 8 wherein said luminaire is disposed on a central axis thereof and wherein a plurality of said perimeter reflectors, when viewed in cross section, are disposed at varied acute angles relative to said central axis.

10. The luminaire of claim 9 further including a radial plane reflector extending radially outwardly from said first means and wherein said perimeter reflectors include a first group of perimeter reflectors extending downwardly from a radial outer edge of said radial plane reflector at a first acute angle relative to said central axis, a second group of perimeter reflectors extending downwardly from said first group of perimeter reflectors at a second acute angle relative to said central axis that is less than said first acute angle, and a third group of perimeter reflectors extending downwardly from said second group of perimeter reflectors and disposed at least approximately parallel relative to said central axis.

11. The luminaire of claim 1 wherein said second means includes first sharp cut-off perimeter reflector means for reflecting a first beam width toward said task field forming a central portion of an illumination pattern thereon, and second sharp cut-off perimeter reflector means for reflecting a second beam width toward said task field overlapping said first beam width to strengthen said illumination pattern.

12. The luminaire of claim 11 wherein said first means further includes third sharp cut-off perimeter reflector means for reflecting a third beam width toward said task field overlapping said second beam width to strengthen an outer portion of said illumination pattern.

13. The luminaire of claim 12 wherein said luminaire is disposed on a central axis thereof and, when viewed in cross-section, said first sharp cut-off perimeter reflector means is disposed at an angle approximating 35° relative to said central axis, said second sharp cut-off perimeter reflector means is disposed at an angle approximating 15° relative to said central axis, and said third sharp cut-off perimeter reflector means is disposed at least approximately parallel relative to said central axis.

14. A luminaire of the direct lighting type disposed on a central axis thereof comprising an annular housing, an annular redirection module releasably attached within said housing and having a pair of opaque reflector disks extending radially outwardly from said axis, at least one high-intensity lamp mounted on radial inner ends and between said reflector disks and positioned for emitting a spherical light pattern confined between said reflector disks to convert said spherical light pattern to only a radial light pattern, an annular and at least substantially transparent window mounted between radial outer ends of said reflector disks, and a reflector module mounted in said housing and having a plurality of sharp cut-off perimeter reflectors spaced radially outwardly from and facing said window for directly receiving and reflecting said radial light pattern into a controlled and substantially uniform light pattern onto a visual task field.

15. The luminaire of claim 14 further including fastening means for releasably attaching said reflector disks centrally within said housing and for simultaneously clamping said window between the outer ends of said reflector disks.

16. The luminaire of claim 14 wherein said reflector module includes a plurality of circumferentially spaced holding barbs secured on an outer surface thereof and engaging said housing to releasably mount said reflector module in said housing.

17. The luminaire of claim 14 further including an annular elastomeric sealing gasket compressed between said reflector module and said housing.

18. The luminaire of claim 14 wherein said reflector disks diverge relative to each other radially outwardly from said axis toward said reflector module.

19. The luminaire of claim 14 wherein each of said perimeter reflectors is flat and wherein at least some of said perimeter reflectors form an acute angle relative to the axis of said luminaire.

20. The luminaire of claim 19 wherein a first group of said perimeter reflectors form a polygonal shape circumferentially about said axis and are disposed at a first acute angle relative to said axis when viewed in cross section, and a second group of said perimeter reflectors extend downwardly from said first group of perimeter reflectors and are disposed at a second acute angle relative to said axis which is less than said first acute angle when viewed in cross section.

21. The luminaire of claim 20 further including an annular radial plane reflector extending radially inwardly towards said redirection module from an upper end of said first group of perimeter reflectors and wherein said perimeter reflectors further include a third group of perimeter reflectors extending downwardly from said second group of perimeter reflectors and disposed in at least approximate parallel relationship relative to said axis.

* * * * *